United States Patent [19]

Lo

[11] 4,342,195

[45] Aug. 3, 1982

[54] MOTORCYCLE EXHAUST SYSTEM

[76] Inventor: Ching P. Lo, 4900 Overland Ave., #115, Culver City, Calif. 90230

[21] Appl. No.: 178,398

[22] Filed: Aug. 15, 1980

[51] Int. Cl.[3] ..... F01N 7/10

[52] U.S. Cl. ..... 60/313; 60/323

[58] Field of Search ..... 60/293, 313, 323, 282; 181/238; 137/265

[56] References Cited

U.S. PATENT DOCUMENTS

| | | | |
|---|---|---|---|
| 2,180,843 | 11/1939 | Zand | 60/313 |
| 3,072,214 | 1/1963 | Deremer | 60/313 |
| 3,653,212 | 4/1972 | Gast | 60/293 |
| 4,154,058 | 5/1979 | Mase | 60/293 |

FOREIGN PATENT DOCUMENTS

| | | | |
|---|---|---|---|
| 52-32417 | 3/1977 | Japan | 60/313 |
| 54-39740 | 3/1979 | Japan | 60/313 |
| 55-66611 | 5/1980 | Japan | 60/313 |

*Primary Examiner*—Douglas Hart

*Attorney, Agent, or Firm*—Fulwider, Patton, Rieber, Lee & Utecht

[57] ABSTRACT

An exhaust system for a motorcycle having at least two exhaust conduits connected to different cylinders of a multiple cylinder motorcycle engine. Each exhaust conduit includes a curved flow divider for directing a portion of the exhaust gases through a crossover pipe for passage through the other exhaust conduit.

15 Claims, 3 Drawing Figures

MOTORCYCLE EXHAUST SYSTEM

BACKGROUND OF THE INVENTION

This invention relates to exhaust systems for motorcycles. More specifically, this invention relates to an improved exhaust conduit system for maximizing motorcycle engine power output and for minimizing engine noise.

A wide variety of exhaust systems are available in the art for use with motorcycle engines. These systems typically comprise one or more exhaust conduits mounted to extend from the engine to the rear of the motorcycle for directing engine exhaust gases to atmosphere. The exhaust conduits define flow paths for exhaust gases from the engine to atmosphere through associated noise abatement mufflers or the like.

Optimally, these exhaust systems are designed to be relatively lightweight, and to provide a low profile for ease of mounting upon and use with motorcycles. Moreover, it is further desirable to provide a motorcycle exhaust system which places minimum backpressure on the engine in order to maximize engine power output, but at the same time satisfactorily reduce motorcycle engine noise to comply with governmental noise regulations. Unfortunately, the goals of maximum power output together with minimum size and weight are generally incompatible with noise reduction, and compliance with mandatory governmental noise regulations can result in a sacrifice in engine performance.

In exhaust systems in general, some attempts in the prior art have been made to reduce engine backpressure without a corresponding increase in engine noise. These attempts have included, for example, various exhaust gas acceleration and baffle arrangments which typically are relatively bulky, and thereby not conveniently usable on motorcycles. See for example, U.S. Pat. Nos. 2,692,025; 3,043,098; and 3,072,214. Other arrangements more specifically designed for motorcycles have been proposed including crossover duct configurations such as that shown in U.S. Pat. No. 3,949,829, wherein multiple crossover pipes are provided for extending the total length of the exhaust system by crossing exhaust gases from one side of the motorcycle to oppositely-mounted mufflers. However, all of these prior art schemes are relatively complicated in construction.

The present invention overcomes the disadvantages of the prior art by providing an improved exhaust system for motorcycles which is relatively simple in construction, and which effectively reduces engine backpressure and minimizes engine noise.

SUMMARY OF THE INVENTION

In accordance with the invention, an exhaust system is provided for use with a motorcycle having at least two engine cylinders in which each of at least two exhaust conduits is fitted with means for diverting a portion of the exhaust gas flow, via a crossover pipe interconnecting the exhaust conduits, from one exhaust conduit to another for exhaustion to atmosphere. Since exhaust gases are discharged from the cylinders in an alternating sequence, each exhaust gas pulse from each cylinder is thus divided for passage through more than one exhaust conduit. This arrangement substantially increases the effective cross-sectional area through which the gases flow, which in turn results in an increase in the expansion ratio and flow rate of the exhaust gases. As a consequence, noise reduction is achieved without substantial sacrifice in engine performance.

More specifically, in a presently preferred embodiment, diversion of gas flow through the crossover pipe is the result of a flow divider disposed in each exhaust conduit somewhat upstream from the crossover pipe. Each flow divider is characterized by a deflection surface oriented generally obliquely to the direction of gas flow in the exhaust conduit. Preferably, each flow divider includes a surface portion that is arcuately shaped in a manner tending to smoothly guide the exhaust gases into the crossover pipe without creation of undue turbulence, which otherwise would contribute to undesired engine backpressure. It is important, however, that the downstream end of each flow divider terminates generally at the upstream extent of the crossover pipe to avoid interference with exhaust gases flowing through the pipe from the opposite direction.

As a further feature of the invention, the crossover pipe is connected between the exhaust conduits as nearly adjacent the exhaust ports of the engine cylinders as practicable and is sized to provide an interconnecting flow area of approximately 70 percent of the flow area of each of the exhaust conduits. Both of these features result in improved performance of the exhaust system of the present invention.

In another important aspect of the invention, the region of connection between the crossover pipe and the exhaust conduits is characterized by shoulders that are curved to facilitate gas flow into and out of the crossover pipe. In this regard, the curvature of each flow divider is generally complementary to the curvature of each shoulder at the upstream extent of the crossover pipe, to further facilitate smooth gas flow without undue turbulence.

The foregoing and other aspects and advantages of the invention will appear from the following detailed description of the presently preferred embodiment, considered together with the accompanying drawing.

BRIEF DESCRIPTION OF THE DRAWINGS

The accompanying drawing illustrates the presently preferred embodiment of the invention. In such drawing.

DETAILED DESCRIPTION OF THE PREFERRED EMBODIMENT

Figure 1:
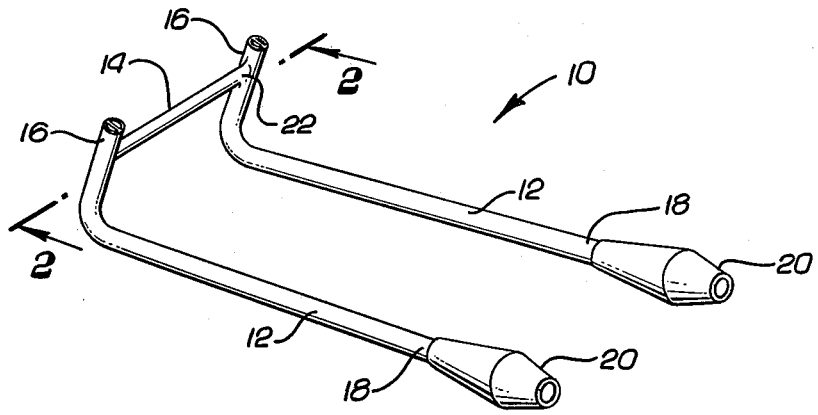
FIG. 1 is a perspective view illustrating the motorcycle exhaust system of this invention.

Referring now to the drawings, and particularly to FIG. 1 thereof, a motorcycle exhaust system 10 is shown having a pair of exhaust conduits 12, which are generally identical to each other, and are suitably curved and configured for appropriate mounting upon the frame of a motorcycle (not shown). These two exhaust conduits 12 each include inlet or upstream ends 16 for appropriate connection to different cylinder exhaust ports of a multiple cylinder motorcycle engine. For example, in a typical two-cylinder engine, the inlet ends 16 of the exhaust conduits 12 are each connected to a different one of the exhaust ports of the two cylinders. Conveniently, the connecting apparatus for mounting the exhaust conduits 12 upon a motorcycle frame, and for connecting the conduit inlet ends 16 to a motorcycle engine, are conventional in the art. Accordingly, these connection details and the hardware therefor, together with the motorcycle frame and engine are not shown or described in detail herein.

The exhaust conduits 12 are respectively connected at their downstream or outlet ends 18 to a pair of motorcycle mufflers 20. The mufflers 20 are also generally conventional in form and include appropriate internal baffles and the like for abating the noise level of the engine as the exhaust gases are passed through the conduits 12 to atmosphere. Importantly, in the exhaust system 10 of this invention, the mufflers 20 may be designed to place minimum backpressure on the motorcycle engine so as not to impair substantially motorcycle performance.

Figure 2:
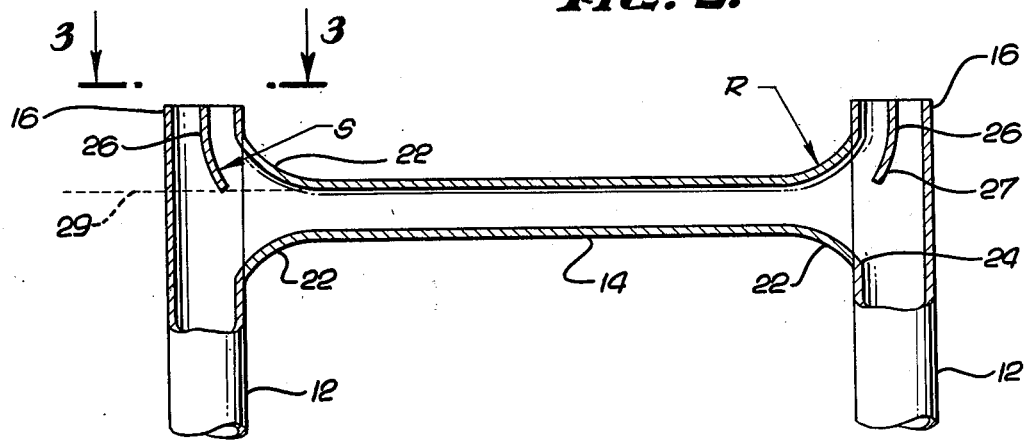
FIG. 2 is an enlarged, fragmented vertical section taken on the line 2—2 of FIG. 1.
Figure 3:
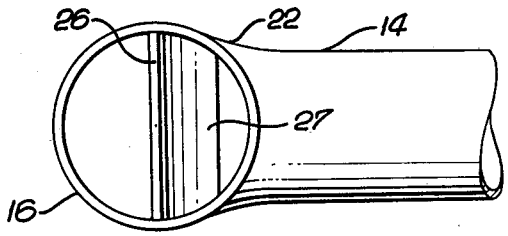
FIG. 3 is an enlarged, fragmented plan view of a portion of the system taken on the line 3—3 of FIG. 2.

In accordance with the present invention, a crossover pipe 14 is interconnected between the two exhaust conduits 12 to increase the effective cross-sectional area presented for the exhaust flow of gases from each engine cylinder. As shown in FIGS. 2 and 3, the crossover pipe 14 has a diameter somewhat smaller than the diameters of the exhaust conduits 12 and is connected between the exhaust conduits 12 near their inlet ends 16. Importantly, the crossover pipe 14 is joined at its opposite ends to the exhaust conduits by arcuately-shaped shoulders, which are specifically configured to smoothly and efficiently guide exhaust gas flow from one of the exhaust conduits 12 through the crossover pipe 14 to the other exhaust conduit. In the preferred embodiment, these shoulders are formed by flared ends 22 on the crossover pipe 14 secured to the two exhaust conduits 12 as by welding.

The flared ends 22 are secured to the exhaust conduits 12 in alignment with a pair of openings 24 formed in the conduits, whereby the crossover pipe 14 defines an open flow path for passage of exhaust gases between the two exhaust conduits. As shown in FIG. 2, these flared ends 22 are each formed generally on a radius "R" and, when connected to the exhaust conduits 12, function to define a smooth transition section between the exhaust conduits 12 and the crossover pipe 14. In the preferred embodiment of the invention, the crossover pipe is sized to have an open flow area equalling approximately 70 percent of the open flow area of each of the exhaust conduits 12.

A flow divider 26 is secured within the inlet end 16 of each exhaust conduit 12. As shown in FIGS. 2 and 3, each flow divider comprises a wall member secured within the associated exhaust conduit 12 as by welding in a position generally to divide exhaust gas flow in the conduit into two substantially equal flow portions. Each of the flow dividers 26 has its upstream end disposed as close as possible to the adjacent open inlet end 16 of the exhaust conduit, and thereby also as close as possible to the associated exhaust port of the motorcycle engine. The flow divider 26 extends from the inlet end 16 downstream within the conduit 12 and includes a curved portion 27 extending toward the crossover pipe 14. This curved portion 27 is formed generally to have a radius of curvature "S" approximately equal to the radius of curvature "R" of the adjacent flared end 22 of the crossover pipe 14, and to extend into the conduit 12 generally in concentric relation with said adjacent flared end 22 of the crossover pipe 14.

As shown in FIG. 2, the downstream end of the curved portion 27 of each flow divider 26 terminates generally at a plane coinciding with the upstream extent of the non-flared portion of the crossover pipe 14, as illustrated by arrow 29 in FIG. 2. In this manner, the flow dividers 26 each effectively direct a portion of the exhaust gases from their associated exhaust port into the crossover pipe 14, but do not interfere with flow of exhaust gases directed into the crossover pipe 14 in the opposite direction by the other flow divider 26. Moreover, the curved portion 27 of each flow divider 26 extends through a sufficient arc, and is formed on a sufficiently small radius to assure that a portion of the exhaust gas flow is smoothly and efficiently turned directionally for flow through the crossover pipe 14. For example, in a preferred embodiment of the invention, the curved portion 27 of each flow divider 26 is formed to extend through an arcuate path of at least about 45°, and is formed on a radius of curvature "S" such that an extension of the radius of curvature would intersect the downstream extent of the crossover pipe 14 at a point displaced inwardly from the adjacent exhaust conduit 12. Preferrably, this intersection point is displaced at least about two inches from the adjacent exhaust conduit.

In operation, the two cylinders of the motorcycle engine fire in an alternating sequence, as is well known in the art. Accordingly, exhaust gases from the engine cylinders are discharged in a rapid alternating sequence first into one of the exhaust conduits 12 and then into the other exhaust conduit 12. In the exhaust system 10 of this invention, each pulse of exhaust gases discharged from one of the cylinders is divided by the associated flow divider 26 for substantially equal flow through the adjacent exhaust conduit 12, and also through the crossover pipe 14 to the opposite exhaust conduit 12. Then, exhaust gases from the other engine cylinder are discharged for division and flow through the two exhaust conduits in an opposite manner, with gas flow through the crossover pipe being in the opposite direction. With this construction, all of the exhaust gases from both of the cylinders are divided at all times for substantially equal passage through both exhaust conduits 12 and both mufflers 20. This results in a substantial reduction in backpressure upon the motorcycle engine to allow for improved engine power output, while at the same time substantially reducing the volume of exhaust gases passing through either conduit 12 or muffler 20 at any one time to substantially reduce engine noise.

A variety of modifications and improvements to the engine exhaust system of this invention are believed to be apparent to one skilled in the art. Accordingly, no limitation on the invention is intended, except as forth in the appended claims.

What is claimed is:

1. For use in a motorcycle having at least two engine cylinders, a motorcycle exhaust system, comprising:

at least a pair of exhaust conduits each having an inlet end connected to a different one of the engine cylinders for receiving exhaust gases discharged therefrom;

a crossover pipe connected between said exhaust conduits and defining an open flow path between said exhaust conduits; and divider means mounted within each of said exhaust conduits for dividing exhaust gases flowing through the associated exhaust conduit into two flow portions, said divider means having a deflection surface for guiding one of the gas flow portions for flow through said crossover pipe to another of said exhaust conduits.

2. An exhaust system as set forth in claim 1, wherein said divider means comprises a flow divider within each of said exhaust conduits, said flow divider having said deflection surface formed thereon and presented generally obliquely to the direction of exhaust gas flow from said engine cylinders and positioned within said exhaust conduit to direct said gas flow portion into said crossover pipe.

3. An exhaust system as set forth in claim 2, wherein at least a portion of the deflection surface of each flow divider is arcuately-shaped to smoothly guide said gas flow portion into said crossover pipe.

4. The exhaust system as set forth in claim 3 wherein said arcuately-shaped surface portion of each of said flow dividers is formed on a radius of curvature wherein said radius intersects the downstream extent of said crossover pipe at a point displaced at least about two inches from said associated exhaust conduit.

5. The exhaust system as set forth in claim 3 wherein said arcuately-shaped surface portion of each of said flow dividers is formed to extend through an arcuate path of at least about 45°.

6. An exhaust system as set forth in claim 2 wherein each of said flow dividers is disposed within said associated exhaust conduit for dividing exhaust gas flowing therethrough into two substantially equal flow portions.

7. An exhaust system as set forth in claim 1 wherein each of said exhaust conduits has formed therein near its inlet end an opening presented toward the other exhaust conduit, and wherein said crossover pipe is connected between said exhaust conduits in flow alignment with the openings formed in said exhaust conduits.

8. An exhaust system as set forth in claim 1 wherein said exhaust conduits are sized substantially identical to each other, and wherein said crossover pipe is sized to provide an open flow area of approximately 70 percent of the open flow area of each of said exhaust conduits.

9. An exhaust system as set forth in claim 1 wherein said crossover pipe is joined to each of said exhaust conduits by arcuately-shaped shoulders, said shoulders serving to smoothly guide exhaust gas flow from one of said exhaust conduits into said crossover pipe, and further from said crossover pipe into another of said exhaust conduits.

10. For use with an engine having at least two engine cylinders firing in an alternating sequence, an exhaust system comprising:

a pair of exhaust conduits each having an inlet end connected to a different one of the engine cylinders for receiving exhaust gases discharged therefrom for passage through said conduits to atmosphere;

a crossover pipe joined to each of said exhaust conduits by curved shoulders and defining an open flow path between said exhaust conduits, said shoulders serving to guide smoothly exhaust gas flow from one of said exhaust conduits into said crossover pipe, and further from said crossover pipe into the other of said exhaust conduits;

and a pair of flow dividers mounted respectively within said exhaust conduits generally adjacent the inlet ends thereof, each of said flow dividers being disposed for dividing exhaust gases flowing through the associated exhaust conduit into two substantially equal flow portions, and including at its downstream end an arcuately-shaped portion extending generally toward the crossover pipe generally concentrically with respect to the adjacent curved shoulder for guiding one of the gas flow portions for flow through said crossover pipe to the other exhaust conduit, whereby exhaust gases from the engine flow at all times in substantially equal portions through both of said exhaust conduits.

11. An exhaust system of claim 10 wherein each of said exhaust conduits includes a noise abatement muffler downstream of the connection with said crossover pipe.

12. An exhaust system of claim 10 wherein said crossover pipe is sized to provide an open flow area of approximately 70 percent of the open flow area of one of said exhaust conduits.

13. An exhaust system of claim 10 wherein said arcuately curved portion of each of said flow dividers terminates within the associated exhaust conduit generally at the upstream extent of said crossover pipe, and is formed on a radius of curvature wherein said radius intersects the downstream extent of said crossover pipe at a point displaced from said associated exhaust conduit.

14. An exhaust system of claim 10 wherein said arcuately curved portion of each of said flow dividers is formed to extend through an arcuate path of at least about 45°.

15. For use with an engine having at least two engine cylinders firing in an alternating sequence, an exhaust system comprising:

a pair of exhaust conduits each having an inlet end connected to a different one of the engine cylinders for receiving exhaust gases discharged therefrom for passage through said conduits to atmosphere;

a crossover pipe joined at opposite ends to each of said exhaust conduits by curved shoulders and defining an open flow path between said exhaust conduits defining an open flow area of about 70 percent of the open flow area of one of said exhaust conduits, said shoulders serving to guide smoothly exhaust gas flow from one of said exhaust conduits into said crossover pipe, and further from said crossover pipe into the other of said exhaust conduits;

a pair of flow dividers mounted respectively within said exhaust conduits generally adjacent the inlet ends thereof, each of said flow dividers being disposed for dividing exhaust gases flowing through the associated exhaust conduit into two substantially equal flow portions, and including at its downstream end an arcuately-shaped portion extending generally toward the crossover pipe generally concentrically with respect to the adjacent shoulder for guiding one of the gas flow portions for flow through said crossover pipe to the other exhaust conduit, said arcuately curved portion of each of said flow dividers extending over an arcuate path of at least about 45° and terminating within the associated exhaust conduit generally at the upstream extent of said crossover pipe, whereby said exhaust gases from the engine flow at all times in substantially equal portions through both of said exhaust conduits; and a pair of noise abatement mufflers mounted respectively along said exhaust conduits downstream of the connection with said crossover pipe.

* * * * *